US006981661B1

(12) United States Patent
Chen

(10) Patent No.: US 6,981,661 B1
(45) Date of Patent: Jan. 3, 2006

(54) SPRAYING GUN

(75) Inventor: Chin-Yuan Chen, Lu Kang Chen (TW)

(73) Assignee: Shin Tai Spurt Water of the Garden Tools Co., Ltd., Lu Kang Chen (TW)

( * ) Notice: Subject to any disclaimer, the term of this patent is extended or adjusted under 35 U.S.C. 154(b) by 0 days.

(21) Appl. No.: 10/898,436

(22) Filed: Jul. 23, 2004

(51) Int. Cl.
*B05B 1/14* (2006.01)
*B05B 15/06* (2006.01)

(52) U.S. Cl. ..... 239/532; 239/526; 239/530; 239/442; 239/444; 239/447; 239/556; 239/561; 239/562; 239/581.1; 239/551

(58) Field of Classification Search ..... 239/280, 239/526, 532, 530, 442, 443, 444, 445, 446, 239/447, 550, 551, 556, 560, 561, 562, 563, 239/581.1, 574, 553, 553.5
See application file for complete search history.

(56) References Cited

U.S. PATENT DOCUMENTS 6,164,566 A * 12/2000 Hui-Chen ..... 239/394
6,216,965 B1 * 4/2001 Chao ..... 239/587.4
6,581,853 B1 * 6/2003 Huang ..... 239/532

* cited by examiner

*Primary Examiner*—David A. Scherbel
*Assistant Examiner*—Jason Boeckmann
(74) *Attorney, Agent, or Firm*—Alan D. Kamrath; Nikolai & Mersereau, P.A.

(57) ABSTRACT

A spraying gun includes a gun body, an adjusting device, a guide pipe, and a spraying nozzle. The adjusting device includes an rotatable knob, and a connecting member. Thus, the sprinkling manner of the spraying gun is adjusted by rotating the rotatable knob of the adjusting device, thereby facilitating a user operating the spraying gun. In addition, the user controls the sprinkling manner of the spraying gun easily, so that the water injected outward from the spraying gun is controlled exactly, thereby preventing the injected water from wetting the user's clothes.

13 Claims, 6 Drawing Sheets

SPRAYING GUN

BACKGROUND OF THE INVENTION

1. Field of the Invention

The present invention relates to a spraying gun, and more particularly to a spraying gun having an adjusting device that can adjust the sprinkling manner of the spraying gun.

2. Description of the Related Art

A conventional spraying gun comprises a gun body having an inside formed with a water channel having a first end connected to a water inlet pipe and a second end connected to a nozzle having a plurality of water outlet holes. The water from the water inlet pipe is introduced into the water channel and is injected outward from the water outlet holes of the nozzle. However, the water from the water inlet pipe is injected outward from the water outlet holes of the nozzle constantly, so that the sprinkling manner of the conventional spraying gun is fixed and cannot be adjusted, thereby limiting the versatility of the conventional spraying gun.

SUMMARY OF THE INVENTION

In accordance with the present invention, there is provided a spraying gun, comprising a gun body, an adjusting device, a guide pipe, and a spraying nozzle, wherein:

- the gun body has a first end formed with a mounting portion formed with a protruding tube;
- the adjusting device is mounted on the gun body and includes an rotatable knob, and a connecting member;
- the rotatable knob of the adjusting device has a first end rotatably mounted on the mounting portion of the gun body and a second end formed with a positioning face having a peripheral wall formed with a water outlet hole communicating with an inside of the rotatable knob;
- the connecting member of the adjusting device is mounted on the positioning face of the rotatable knob and has an inside formed with a plurality of water conducting holes selectively communicating with the water outlet hole of the rotatable knob;
- the connecting member of the adjusting device has a first side formed with a pipe secured on the tube of the gun body and having a peripheral wall formed with a plurality of water inlet holes each communicating with the tube of the gun body and the inside of the rotatable knob;
- the connecting member of the adjusting device has a second side formed with a support stud having an inside formed with a plurality of water outlet channels each communicating with a respective one of the water conducting holes of the connecting member;
- the guide pipe is mounted on the adjusting device and has an inside formed with a plurality of water guide channels each communicating with a respective one of the water outlet channels of the connecting member; and
- the spraying nozzle is mounted on the guide pipe and includes a water guide disk mounted on an upper end of the guide pipe and having an inside formed with a plurality of water conducting channels each communicating with a respective one of the water guide channels of the guide pipe, and a water outlet cover mounted on the water guide disk and having an inside formed with a plurality of water outlets holes each communicating with a respective one of the water conducting channels of the water guide disk.

The primary objective of the present invention is to provide a spraying gun having an adjusting device that can adjust the sprinkling manner of the spraying gun.

Another objective of the present invention is to provide a spraying gun, wherein the sprinkling manner of the spraying gun is adjusted by rotating the rotatable knob of the adjusting device, thereby facilitating a user operating the spraying gun.

A further objective of the present invention is to provide a spraying gun, wherein the user controls the sprinkling manner of the spraying gun easily, so that the water injected outward from the spraying gun is controlled exactly, thereby preventing the injected water from wetting the user's clothes.

A further objective of the present invention is to provide a spraying gun, wherein the adjusting device is adjusted easily and conveniently, thereby facilitating the user controlling the spraying gun.

Further benefits and advantages of the present invention will become apparent after a careful reading of the detailed description with appropriate reference to the accompanying drawings.

DETAILED DESCRIPTION OF THE INVENTION

Figure 1:
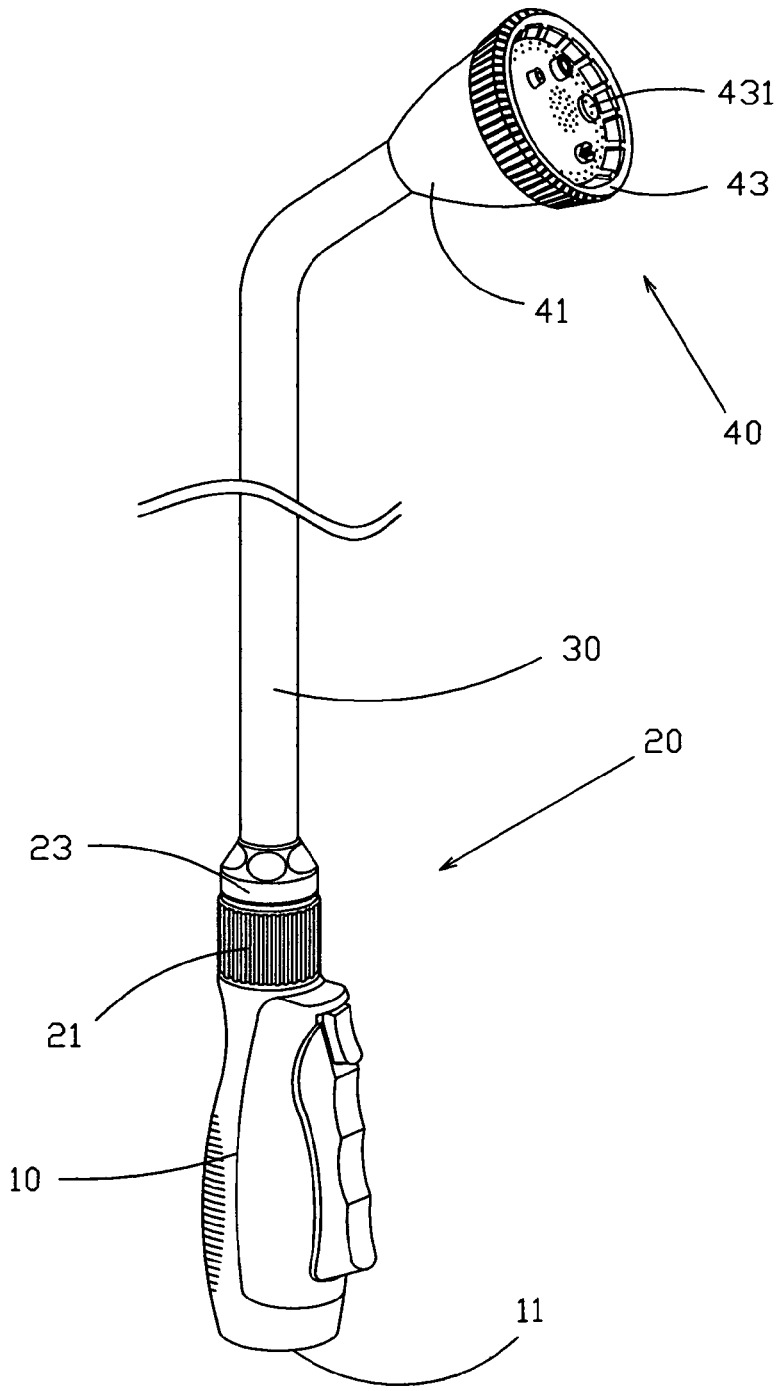
FIG. 1 is a partially cut-away perspective view of a spraying gun in accordance with the preferred embodiment of the present invention.
Figure 2:
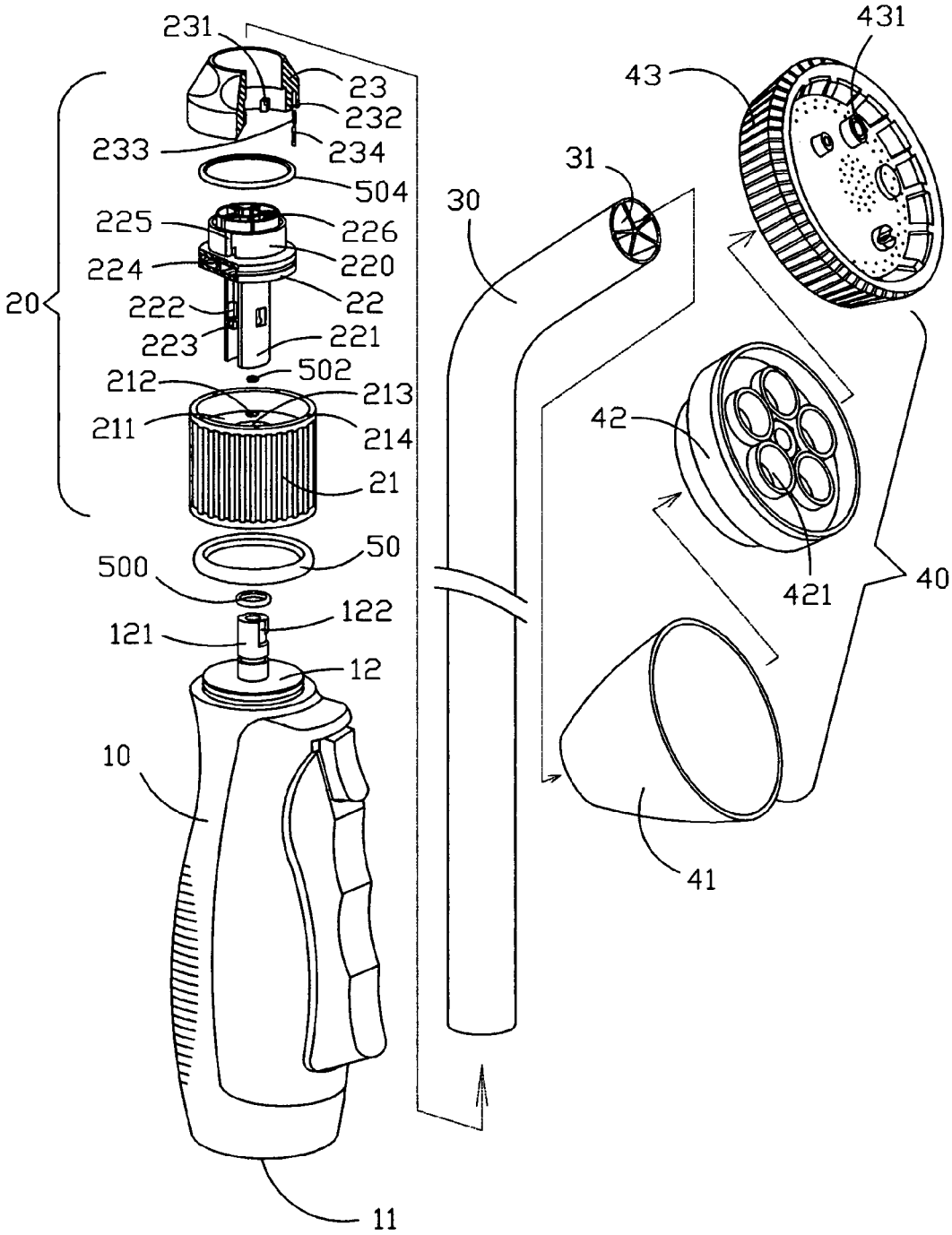
FIG. 2 is an exploded perspective view of the spraying gun as shown in FIG. 1.
Figure 3:
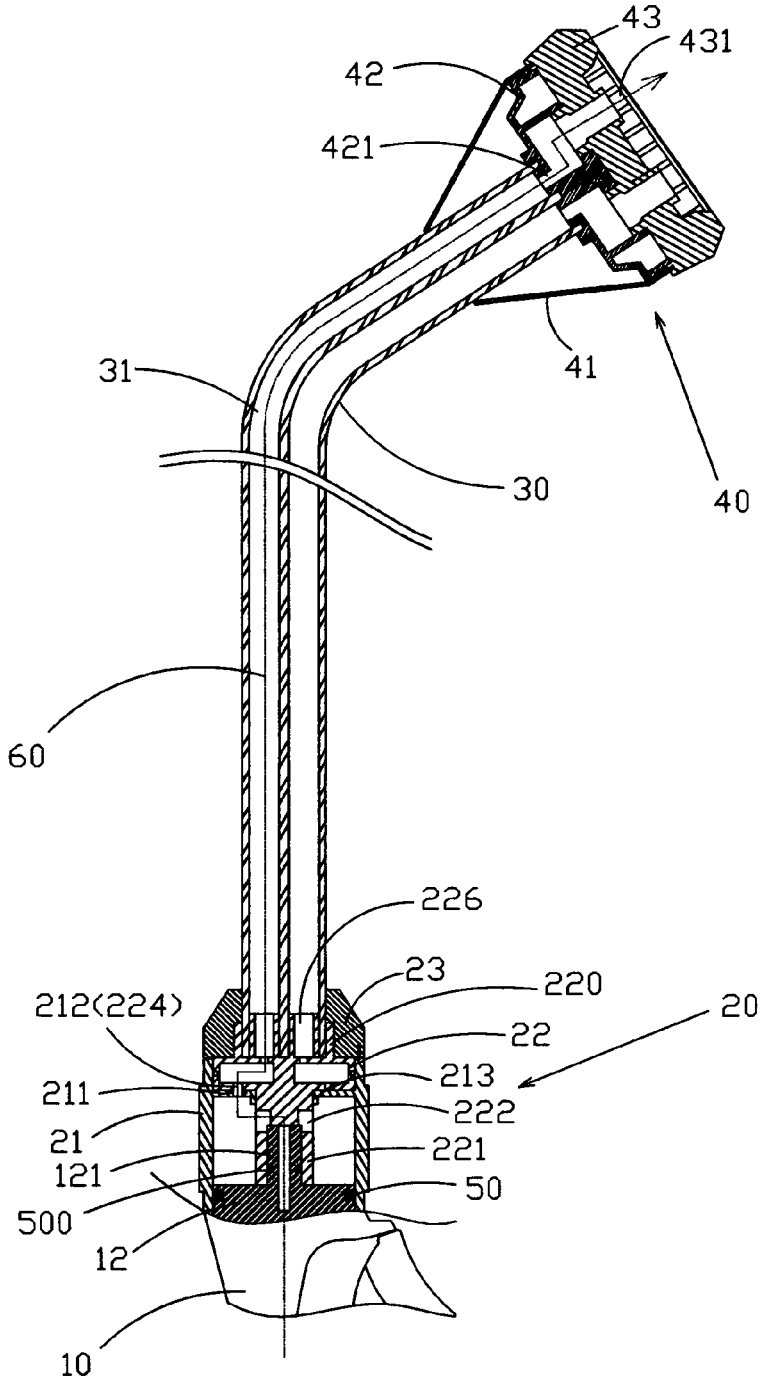
FIG. 3 is a side plan cross-sectional view of the spraying gun as shown in FIG. 1.
Figure 4:
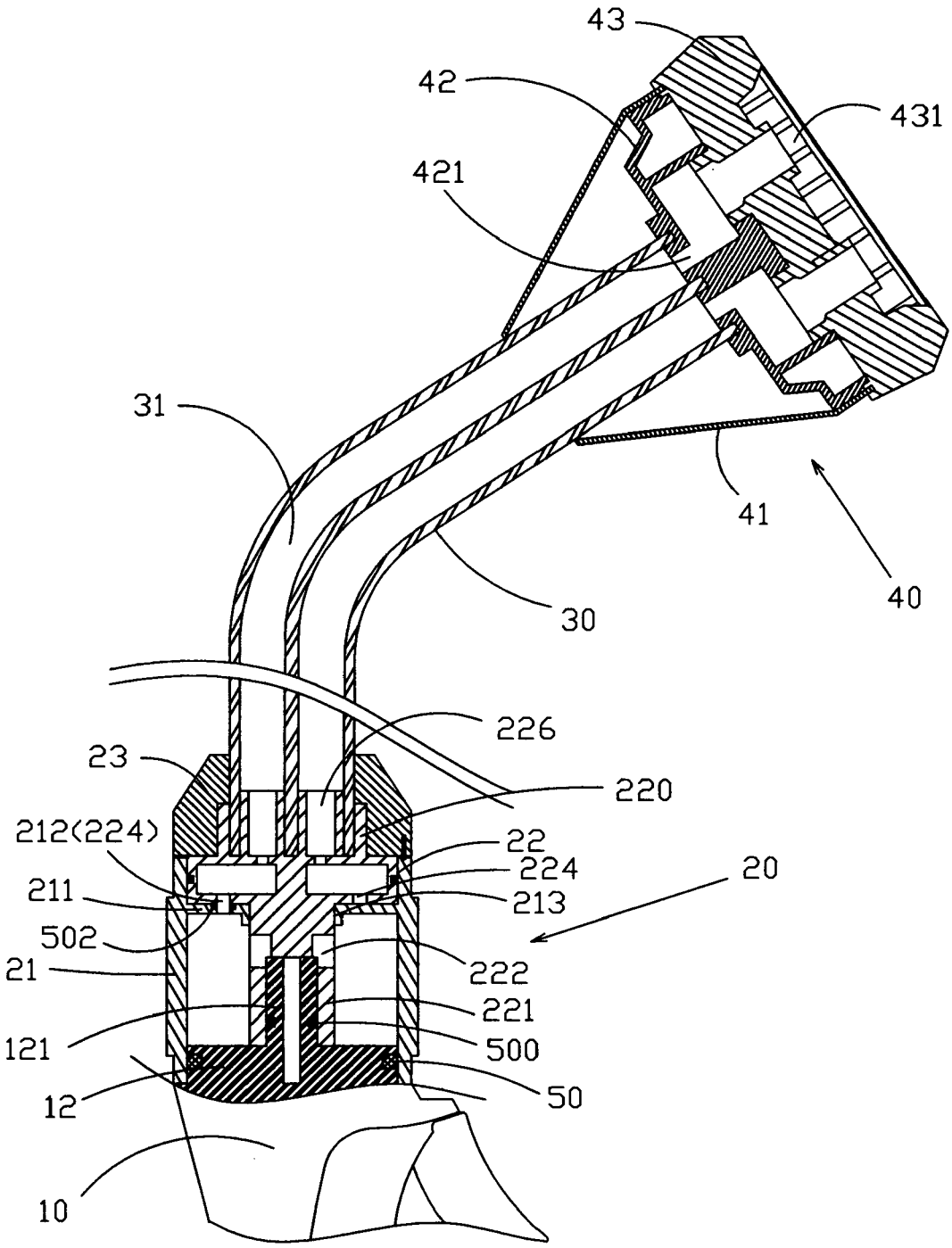
FIG. 4 is a partially enlarged view of the spraying gun as shown in FIG. 3.

Referring to the drawings and initially to FIGS. 1–5, a spraying gun in accordance with the preferred embodiment of the present invention comprises a gun body 10, an adjusting device 20, a guide pipe 30, and a spraying nozzle 40.

The gun body 10 has a first end formed with a mounting portion 12 and a second end formed with a connecting port 11. An O-ring 50 is mounted on a peripheral wall of the mounting portion 12 of the gun body 10. The mounting portion 12 of the gun body 10 is formed with a protruding tube 121 having a peripheral wall formed with a locking groove 122. An O-ring 500 is mounted on the peripheral wall of the tube 121 of the gun body 10.

The adjusting device 20 is mounted on the gun body 10 and includes an rotatable knob 21, a connecting member 22, and a support jacket 23.

The rotatable knob 21 of the adjusting device 20 has a first end rotatably mounted on the mounting portion 12 of the gun body 10 and a second end formed with a positioning face 211 having a peripheral wall formed with a water outlet hole 212 communicating with the inside of the rotatable knob 21. The positioning face 211 of the rotatable knob 21 has a central portion formed with a mounting hole 213. The second end of the rotatable knob 21 of the adjusting device 20 has a peripheral wall formed with a plurality of positioning holes 214.

Figure 5:
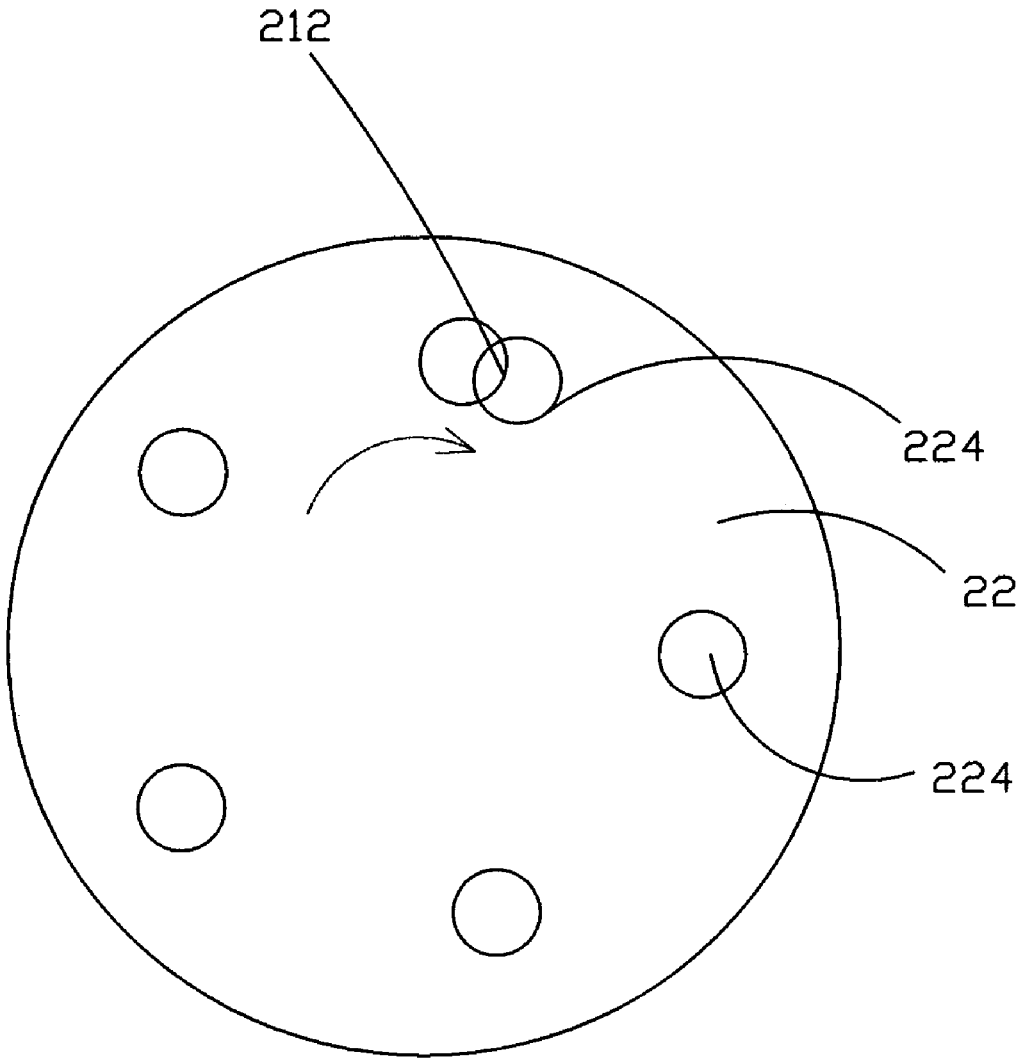
FIG. 5 is a partially plan operational view of the spraying gun as shown in FIG. 1 in adjustment.

The connecting member 22 of the adjusting device 20 is mounted on the positioning face 211 of the rotatable knob 21 and has an inside formed with a plurality of water conducting holes 224 selectively communicating with the water outlet hole 212 of the rotatable knob 21 as shown in FIG. 5. An O-ring 504 is mounted on a peripheral wall of the connecting member 22. The connecting member 22 of the adjusting device 20 has a first side formed with a pipe 221 secured on the tube 121 of the gun body 10 and having a peripheral wall formed with a plurality of water inlet holes 222 each communicating with the tube 121 of the gun body 10 and the inside of the rotatable knob 21. The pipe 221 of the connecting member 22 is extended through the mounting hole 213 of the rotatable knob 21. The pipe 221 of the connecting member 22 has an inside formed with a locking block 223 locked in the locking groove 122 of the tube 121 of the gun body 10. The connecting member 22 of the adjusting device 20 has a second side formed with a support stud 220 having an inside formed with a plurality of water outlet channels 226 each communicating with a respective one of the water conducting holes 224 of the connecting member 22. The support stud 220 of the connecting member 22 has a peripheral wall formed with a locking slot 225.

The support jacket 23 of the adjusting device 20 is secured on the support stud 220 of the connecting member 22 and has an inside formed with a locking block 231 locked in the locking slot 225 of the support stud 220 of the connecting member 22. The support jacket 23 of the adjusting device 20 has a peripheral wall formed with a receiving hole 232 for receiving an elastic member 233 and a positioning pin 234 which is movable and selectively positioned in either one of the positioning holes 214 of the rotatable knob 21.

The guide pipe 30 is mounted on the adjusting device 20 and has an inside formed with a plurality of water guide channels 31 each communicating with a respective one of the water outlet channels 226 of the connecting member 22. The guide pipe 30 has a lower end extended through the support jacket 23 of the adjusting device 20 and mounted in the support stud 220 of the connecting member 22.

The spraying nozzle 40 is mounted on the guide pipe 30 and includes a water guide disk 42 mounted on an upper end of the guide pipe 30 and having an inside formed with a plurality of water conducting channels 421 each communicating with a respective one of the water guide channels 31 of the guide pipe 30, a water outlet cover 43 mounted on the water guide disk 42 and having an inside formed with a plurality of water outlets holes 431 each communicating with a respective one of the water conducting channels 421 of the water guide disk 42, and a shade 41 mounted on the upper end of the guide pipe 30 and rested on the water guide disk 42 to support the water guide disk 42.

Figure 6:
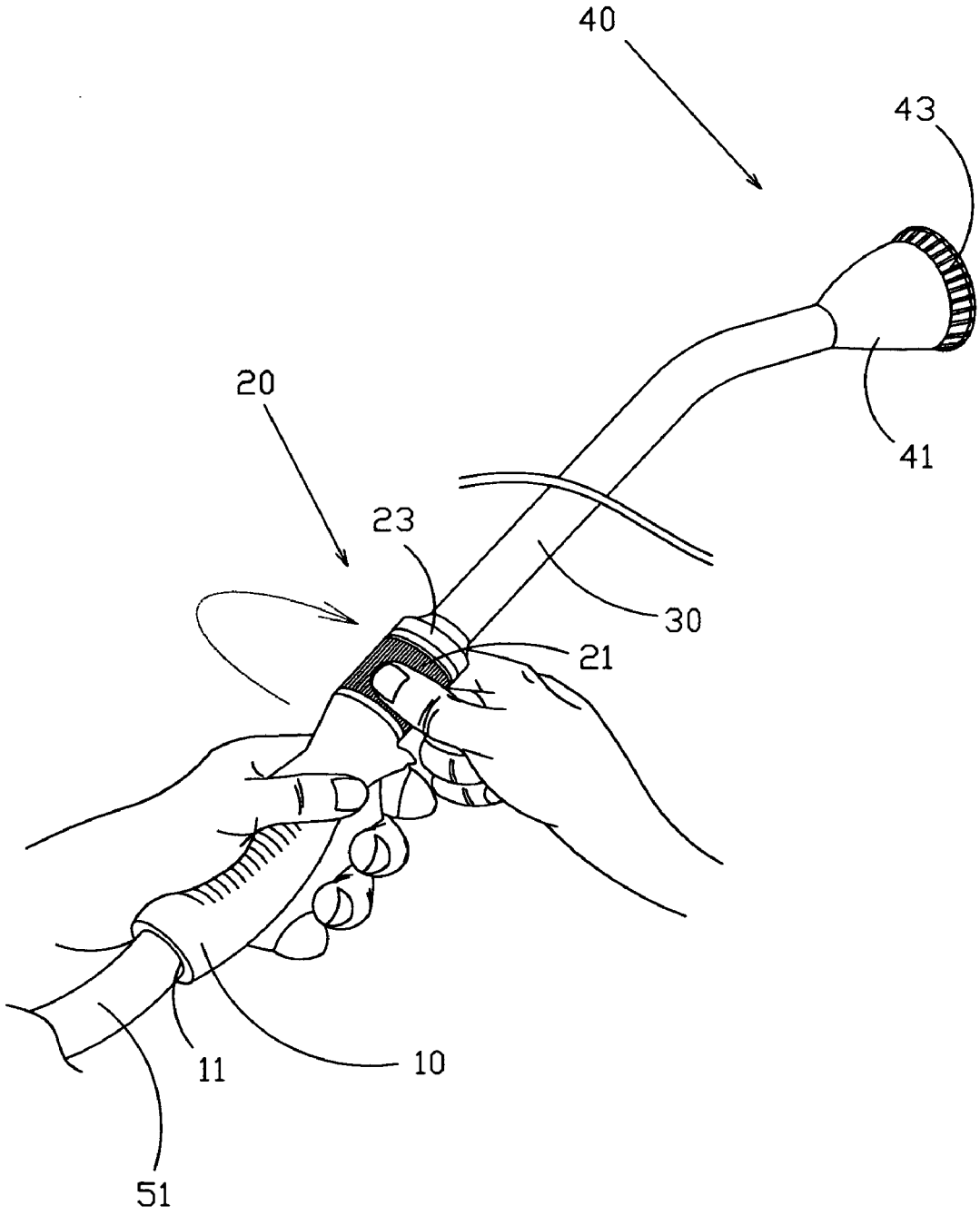
FIG. 6 is a schematic operational view of the spraying gun as shown in FIG. 1.

When in use, referring to FIGS. 1–6, the connecting port 11 of the gun body 10 is mounted on a water inlet pipe 51 as shown in FIG. 6, so that the water 60 (see FIG. 3) from the water inlet pipe 51 in turn flows through the inside of the gun body 10, the tube 121 of the gun body 10, the water inlet holes 222 of the pipe 221 of the connecting member 22, the inside of the rotatable knob 21, the water outlet hole 212 of the rotatable knob 21, either one of the water conducting holes 224 of the connecting member 22, either one of the water outlet channels 226 of the connecting member 22, either one of the water guide channels 31 of the guide pipe 30 and either one of the water conducting channels 421 of the water guide disk 42, and is injected outward from either one of the water outlets holes 431 of the water outlet cover 43 for use.

In such a manner, the water from the water inlet pipe 51 is injected outward from a single one of the water outlets holes 431 of the water outlet cover 43 for use.

Alternatively, as shown in FIGS. 5 and 6, the rotatable knob 21 is rotated relative to the gun body 10, so that the water outlet hole 212 of the rotatable knob 21 is moved to align with either one of the water conducting holes 224 of the connecting member 22.

In such a manner, the water from the water inlet pipe 51 is injected outward from either one of the water outlets holes 431 of the water outlet cover 43, thereby changing and adjusting the sprinkling manner of the spraying gun.

Accordingly, the sprinkling manner of the spraying gun is adjusted by rotating the rotatable knob 21 of the adjusting device 20, thereby facilitating a user operating the spraying gun. In addition, the user controls the sprinkling manner of the spraying gun easily, so that the water injected outward from the spraying gun is controlled exactly, thereby preventing the injected water from wetting the user's clothes. Further, the adjusting device 20 is adjusted easily and conveniently, thereby facilitating the user controlling the spraying gun.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A spraying gun, comprising a gun body, an adjusting device, a guide pipe, and a spraying nozzle, wherein:

the gun body has a first end formed with a mounting portion formed with a protruding tube;

the adjusting device is mounted on the gun body and includes a rotatable knob, and a connecting member;

the rotatable knob of the adjusting device has a first end rotatably mounted on the mounting portion of the gun body and a second end formed with a positioning face having a peripheral wall formed with a water outlet hole communicating with an inside of the rotatable knob;

the connecting member of the adjusting device is mounted on the positioning face of the rotatable knob and has an inside formed with a plurality of water conducting holes selectively communicating with the water outlet hole of the rotatable knob;

the connecting member of the adjusting device has a first side formed with a pipe secured on the tube of the gun body and having a peripheral wall formed with a plurality of water inlet holes each communicating with the tube of the gun body and the inside of the rotatable knob;

the connecting member of the adjusting device has a second side formed with a support stud having an inside formed with a plurality of water outlet channels each communicating with a respective one of the water conducting holes of the connecting member;

the guide pipe is mounted on the adjusting device and has an inside formed with a plurality of water guide channels each communicating with a respective one of the water outlet channels of the connecting member; and the spraying nozzle is mounted on the guide pipe and includes a water guide disk mounted on an upper end of the guide pipe and having an inside formed with a plurality of water conducting channels each communicating with a respective one of the water guide channels of the guide pipe, and a water outlet cover mounted on the water guide disk and having an inside formed with a plurality of water outlets holes each communicating with a respective one of the water conducting channels of the water guide disk.

2. The spraying gun in accordance with claim 1, wherein the tube of the gun body has a peripheral wall formed with a locking groove, and the pipe of the connecting member has an inside formed with a locking block locked in the locking groove of the tube of the gun body.

3. The spraying gun in accordance with claim 1, wherein the positioning face of the rotatable knob has a central portion formed with a mounting hole, and the pipe of the connecting member is extended through the mounting hole of the rotatable knob.

4. The spraying gun in accordance with claim 1, wherein the adjusting device further includes a support jacket secured on the support stud of the connecting member.

5. The spraying gun in accordance with claim 4, wherein the support stud of the connecting member has a peripheral wall formed with a locking slot, and the support jacket of the adjusting device has an inside formed with a locking block locked in the locking slot of the support stud of the connecting member.

6. The spraying gun in accordance with claim 4, wherein the second end of the rotatable knob of the adjusting device has a peripheral wall formed with a plurality of positioning holes, and the support jacket of the adjusting device has a peripheral wall formed with a receiving hole for receiving an elastic member and a positioning pin which is movable and selectively positioned in either one of the positioning holes of the rotatable knob.

7. The spraying gun in accordance with claim 4, wherein the guide pipe has a lower end extended through the support jacket of the adjusting device.

8. The spraying gun in accordance with claim 1, wherein the guide pipe has a lower end mounted in the support stud of the connecting member.

9. The spraying gun in accordance with claim 1, wherein the spraying nozzle further includes a shade mounted on the upper end of the guide pipe and rested on the water guide disk to support the water guide disk.

10. The spraying gun in accordance with claim 1, wherein the gun body has a second end formed with a connecting port.

11. The spraying gun in accordance with claim 1, further comprising an O-ring mounted on a peripheral wall of the mounting portion of the gun body.

12. The spraying gun in accordance with claim 1, further comprising an O-ring mounted on the peripheral wall of the tube of the gun body.

13. The spraying gun in accordance with claim 1, further comprising an O-ring mounted on a peripheral wall of the connecting member.

* * * * *